US006076605A

United States Patent [19]

Lilley et al.

[11] Patent Number: 6,076,605

[45] Date of Patent: Jun. 20, 2000

[54] HORIZONTAL TREE BLOCK FOR SUBSEA WELLHEAD AND COMPLETION METHOD

[75] Inventors: Robert O. Lilley, Farno, Italy; Stephen P. Fenton, Aberdeen, United Kingdom; David S. Christie, Aberdeen, United Kingdom; Peter A. Scott, Aberdeen, United Kingdom; Walter J. Lacey, Aberdeenshire, United Kingdom

[73] Assignee: ABB Vetco Gray Inc., Houston, Tex.

[21] Appl. No.: 08/982,086

[22] Filed: Dec. 1, 1997

(Under 37 CFR 1.47)

Related U.S. Application Data

[60] Provisional application No. 60/032,068, Dec. 2, 1996.

[51] Int. Cl.[7] ..... E21B 34/04

[52] U.S. Cl. ..... 166/368; 166/344; 166/360; 166/95.1; 166/382

[58] Field of Search ..... 166/88.1, 75.14, 166/95.1, 97.1, 346, 368, 379, 381, 382, 386, 344, 360

[56] References Cited

U.S. PATENT DOCUMENTS

| | | | |
|---|---|---|---|
| 5,465,794 | 11/1995 | McConaughy et al. | 166/375 |
| 5,544,707 | 8/1996 | Hopper et al. | 166/382 |
| 5,575,336 | 11/1996 | Morgan | 166/330 |
| 5,868,204 | 2/1999 | Pritchett et al. | 166/368 |
| 5,884,706 | 3/1999 | Edwards | 166/335 |

FOREIGN PATENT DOCUMENTS

86/01852 3/1986 WIPO .

*Primary Examiner*—Eileen Dunn Lillis
*Assistant Examiner*—John Kreck
*Attorney, Agent, or Firm*—Felsman Bradley Vaden Gunter & Dillon, LLP; James E. Bradley

[57] ABSTRACT

A subsea wellhead assembly has a tubular housing having a sidewall, an axial bore, and a housing lateral passage extending from the bore through the sidewall. A blocking sleeve fits around the housing to block the housing lateral passage while drilling through the housing. A tubing hanger is secured to a string of tubing and landed in the housing. The tubing hanger has a vertical passage which communicates with the tubing and a tubing lateral passage which extends from the vertical passage and registers with the housing lateral passage. A lower annulus port is in the sidewall of the housing below the lower seal and leads to a tubing annulus. An upper annulus port is in the sidewall of the housing above the upper seal and leads to the bore of the housing. A tree block having a central opening for receiving the housing is lowered over the housing after removal of the blocking sleeve. The tree block has a tree production passage which registers with the housing lateral passage for directing flow of production fluid from the well. A production valve is mounted to the tree block for opening and closing the tree production passage. A bypass passage in the tree block connects the upper and lower annulus ports to communicate the bore above the tubing hanger with the tubing annulus.

20 Claims, 4 Drawing Sheets

HORIZONTAL TREE BLOCK FOR SUBSEA WELLHEAD AND COMPLETION METHOD

This application claims benefit of Provisional Application 60/032,068 filed Dec. 2, 1996.

TECHNICAL FIELD

This invention relates in general to wellhead equipment, and in particular to a production tree having a tubing hanger therein, the tubing hanger and production tree having lateral production passages.

BACKGROUND ART

A conventional subsea wellhead assembly includes a high pressure wellhead housing which supports one or more casing hangers located at upper ends of strings of casing extending into the well. A tubing hanger lands in the wellhead housing above the casing hanger and supports a string of production tubing that extends through the smallest diameter casing. The tubing hanger has a production bore which is offset slightly from the longitudinal axis. An annulus bore also extends through the tubing hanger, parallel to and offset from the axis, for communicating the tubing annulus to above the tubing hanger. The annulus bore is needed during installation of the tubing hanger and tubing to establish circulation down the tubing and back up the annulus. After the well has been completed, a removable plug is installed in the annulus bore, then a production tree is mounted to the wellhead housing. Access through the production tree to the tubing may be made for various workover operations that are needed. Various production valves and chokes will be mounted to the tree.

In the last few years, operators have begun installing a different type of wellhead assembly, referred to generally as a horizontal tree. In a horizontal tree, the tubing hanger lands in the tree, not in the wellhead housing located below the tree. The tubing hanger has a lateral flow passage extending from its vertical flow passage. The lateral flow passage registers with a lateral flow passage extending through a sidewall of the tree. With the horizontal tree, a tubing hanger can be pulled through the horizontal tree without removing the tree. Various production valves and chokes are mounted to the horizontal tree in the same manner as with a conventional tree.

In both types of trees, the valves and chokes are not readily accessible from the surface. Some work can be performed with a remote operated vehicle. If the entire valve needs to be replaced, it may be necessary to retrieve the tree. This is a time consuming and expensive task, particularly with a horizontal tree because the tubing must be pulled first.

SUMMARY OF INVENTION

In this invention, the tree comprises a housing and a tree block. The housing has a sidewall, an axial bore, and a housing lateral passage extending from the bore through the sidewall. The tree block has a central opening, a tree production passage which extends from the central opening, and a production valve in the tree production passage. After the well is drilled to a first depth, the housing is installed similar to a conventional high pressure wellhead housing. A blocking sleeve will be installed which blocks the housing lateral passage from the exterior. Drilling continues through the housing, and after drilling is completed, casing is installed, with the casing hanger landing in the housing.

The blocking sleeve is removed from the housing after the casing hanger has been installed. A string of tubing is run, with the tubing hanger landing in the housing above the casing hanger. The tubing hanger has a vertical passage which communicates with the tubing, and a tubing lateral passage which extends from the vertical passage and registers with the housing lateral passage. After removal of the blocking sleeve, the operator lowers the tree block over the housing with the housing lateral passage registering with the tree production passage.

DETAILED DESCRIPTION

Figure 1:
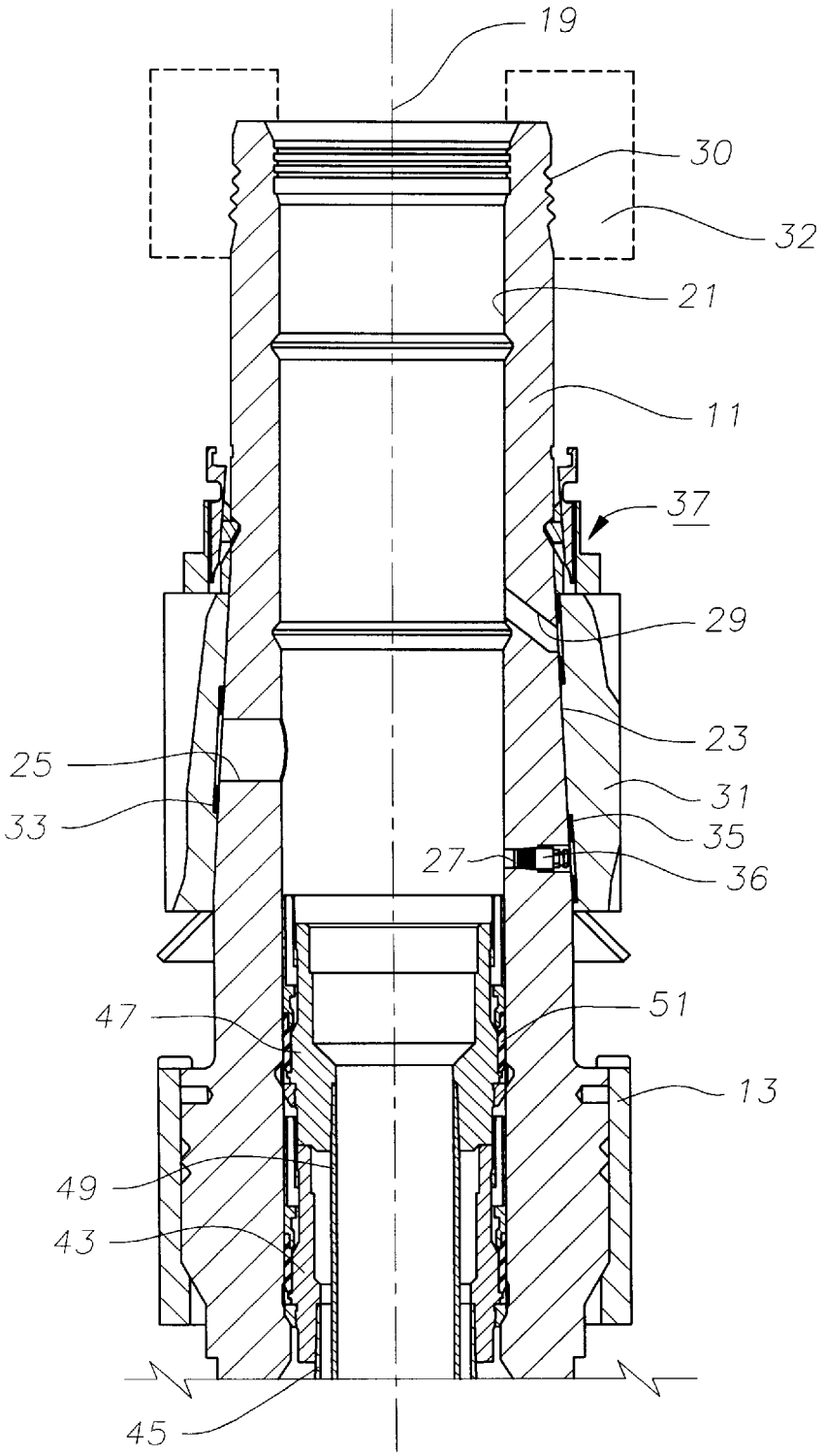
FIG. 1 is a vertical sectional view illustrating a subsea wellhead assembly constructed in accordance with this invention, and shown after the well has been drilled but prior to running tubing.

Referring to FIG. 1, wellhead housing 11 is located subsea on the sea floor. Wellhead housing 11 is a tubular member that is mounted within a receptacle in a base 13 that is supported on the sea floor. Base 13 has a guide frame 15 (FIG. 4) for guiding tools and equipment from a floating drilling vessel (not shown).

Wellhead housing 11 is secured to the upper end of a string of conductor pipe (not shown) that extends into the well to a first depth. Wellhead housing 11 has a longitudinal axis 19 with an axial bore 21. The exterior of wellhead housing 11 is generally cylindrical and has a seat section 23 that is conical or tapered a few degrees. The diameter of seat section 23 at its upper end is smaller than the diameter of seat section 23 at its lower end. A production passage 25 extends through the wall of wellhead housing 11 perpendicular to axis 19, having an inlet in bore 21 and an outlet located at seat section 23. Wellhead housing 11 also has a lower annulus port 27 and an upper annulus port 29 spaced axially above. Annulus ports 27, 29 also have outlets in seat section 23. A drilling riser 32 with a blowout preventer will releasably secure to a grooved profile 30 on the upper end of wellhead housing 11.

A blocking sleeve 31 will initially be mounted to the exterior of wellhead housing 11, covering seat section 23 and closing production passage 25 and annulus ports 27, 29. Blocking sleeve 31 is a tubular member that has a bore that is tapered to match the taper of seat section 23. Blocking sleeve 31 has a set of seals 33 for sealing around the outlet of production passage 25. Seals 33 do not extend around blocking sleeve 31, rather encircle production passage 25, coaxially with the axis of passage 25. Blocking sleeve 31 also has annulus seals 35 for sealing around the outlets of annulus ports 27, 29. Annulus seals 35 also encircle each annulus port 27, 29 coaxially with the axis of each port 27, 29. Seals 33, 35 may be of various types. A lower annulus port plug 36 will initially be installed in lower annulus port 27.

Figure 2:
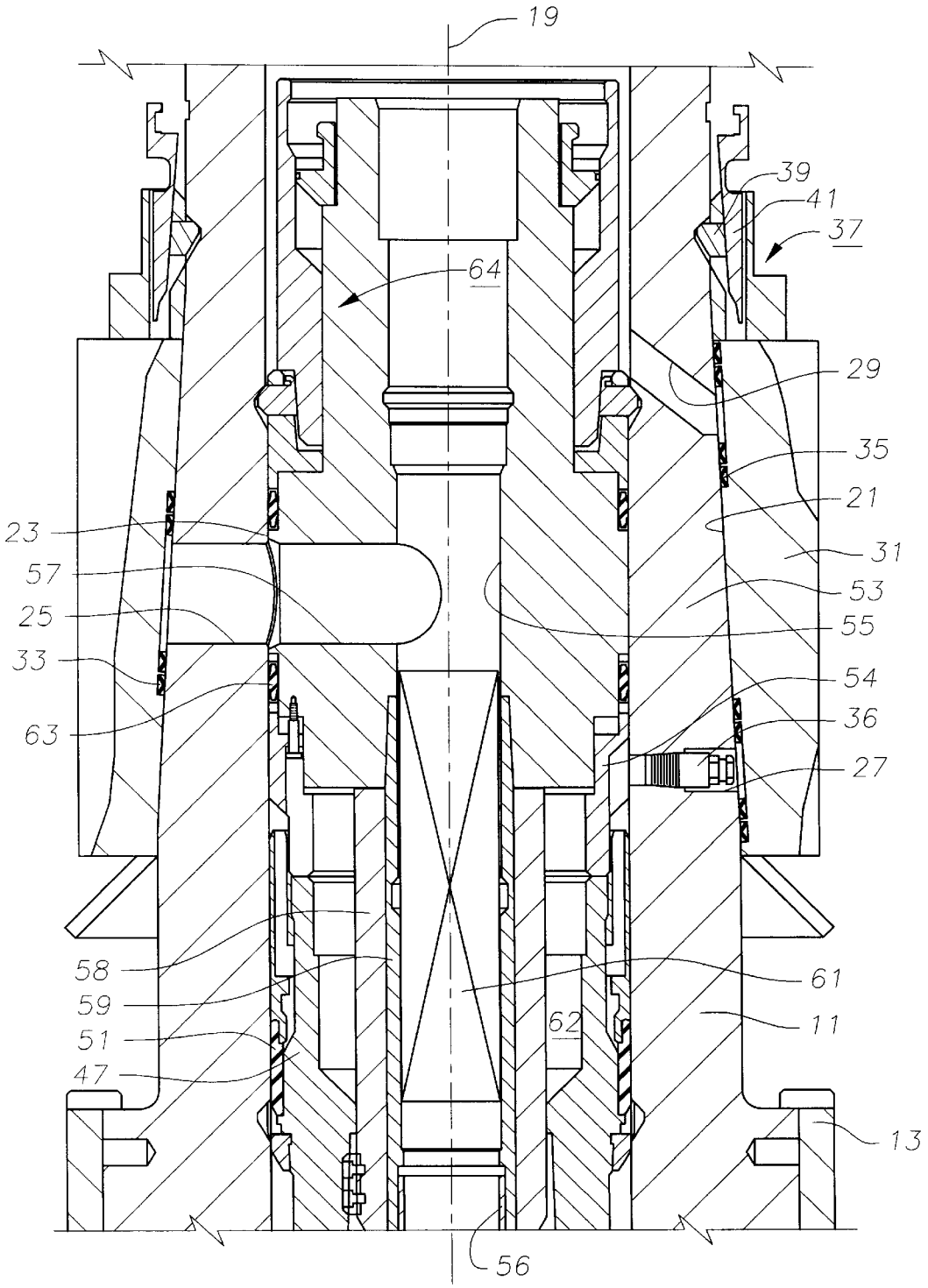
FIG. 2 is an enlarged sectional view of the wellhead assembly of FIG. 1, shown after the tubing has been run but before installing a tree block.

A locking member 37 releasably locks blocking sleeve 31 around wellhead housing 11 and is also engageable by a retrieval tool (not shown) for retrieving blocking sleeve 31. Locking member 37 may be of various types. As shown in FIG. 2, it has an outward biased split ring 39 which engages a groove on the exterior of wellhead housing 11. An axially moveable cam ring 41, when pushed downward, wedges split ring 39 into the engaged position. Cam ring 41 has a hook profile on its upper edge to allow it to be pulled upward to release split ring 39, allowing retrieval of blocking sleeve 31.

Referring again to FIG. 1, a lower casing hanger 43 is installed on a landing shoulder in bore 21. Lower casing hanger 43 is secured to a string of casing 45 which extends into the well to a second depth. An upper casing hanger 47 lands on lower casing hanger 43. Upper casing hanger 47 is secured to a string of casing 49 which extends into the well to a third depth. Casing hangers 43, 47 are sealed to bore 21 by conventional casing hanger seals 51, which may be of various types and are shown schematically. The well will be drilled through wellhead housing 11 and casing hangers 43, 47 installed as shown in FIG. 1.

Referring to FIG. 2, a tubing hanger 53 is then run and supported on upper casing hanger 47 by an extension member 54. Tubing hanger 53 has a vertical passage 55 that extends completely through it coaxial with axis 19. Vertical passage 55 is coaxial with a string of tubing 56 which extends into the well. A lateral passage 57 intersects vertical passage 55 and extends outward perpendicular to axis 19. An orientation sleeve 58 with a key is mounted to the lower side of tubing hanger 53 and engages an alignment slot in upper casing hanger 47 to cause tubing hanger 53 to orient. Lateral passage 57 will be coaxial with housing production passage 25 when installed. A plug landing member 59 is located at the lower end of tubing hanger 53 for receiving a wireline retrievable plug 61, shown schematically. Plug 61 is of a conventional type and is run by wireline after tubing hanger 53 has been installed.

Tubing hanger 53 has seals 63 above and below lateral passage 57 for sealing lateral passage 57. In the embodiment shown, tubing hanger seals 63 are a gallery type, extending around tubing hanger 53 coaxial with axis 19. Both tubing hanger seals 63 are located between upper and lower annulus ports 29, 27. Extension member 54, which supports tubing hanger 53 has slots in it to communicate a tubing annulus 62 surrounding tubing 56 with lower annulus port 27. Annulus plug 36 in lower annulus passage 27 serves to provide a barrier when blocking sleeve 31 is being retrieved. Tubing hanger 53 is locked in wellhead housing 11 with a conventional lock assembly 64.

Figure 3:
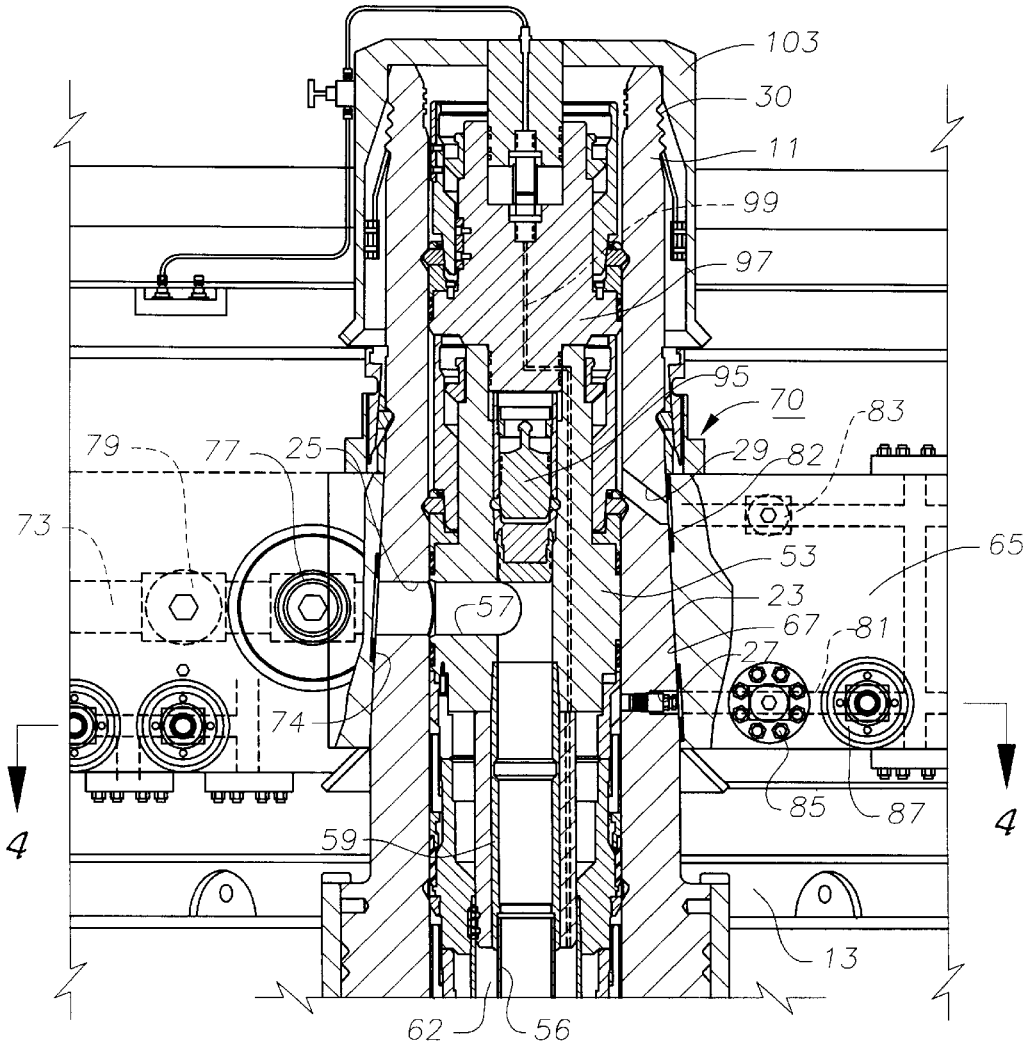
FIG. 3 is a sectional view of the wellhead assembly of FIG. 1, shown after installation of the tree block.
Figure 4:
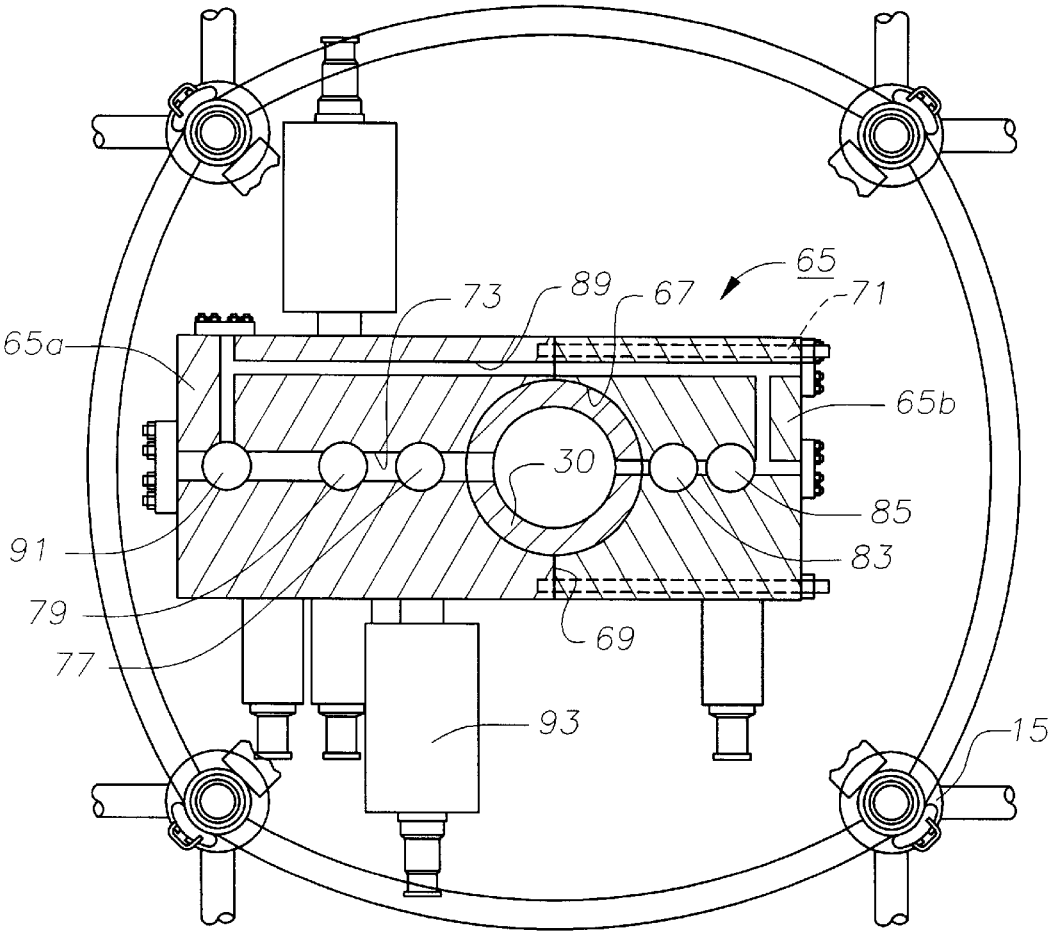
FIG. 4 is a sectional view of the wellhead assembly of FIG. 1, taken along the line of 4—4 of FIG. 3.

After the well has been completed to the extent shown in FIG. 2, with wireline plug 61 installed, the operator removes drilling riser 32 and retrieves blocking sleeve 31. Then, a tree block 65, shown in FIG. 3, is lowered over wellhead housing 11. As shown also in FIG. 4, tree block 65 is a generally rectangular member having a longitudinal axis that is perpendicular to wellhead housing axis 19. Tree block 65 has a hole 67 that extends through it from its upper side to its lower side. Hole 67 is tapered to match the slight conical contour of wellhead housing seat section 23. In the preferred embodiment, tree block 65 is comprised of two separate sections 65*a*, 65*b*, as shown in FIG. 4. Each section 65*a*, 65*b* contains a portion of hole 67. Each section 65*a*, 65*b* has a joining side wall 69 which abut each other when installed. Sections 65*a*, 65*b* of tree block 65 are secured together by bolts 71 in the embodiment shown. Bolts 71 extend from one side of section 65*b* into section 65*a*. Alternately, a clamp member (not shown) could be employed. In the preferred method of operation, bolts 71 will be loosened slightly while tree block 65 is being lowered over wellhead housing 11, producing a clearance gap to facilitate installation. A locking member 70 similar to locking member 37 retains tree block 65 to wellhead housing 11.

Tree block 65 has all of the required passages and valves of a horizontal tree such as shown in U.S. Pat. No. 5,465,794, Nov. 14, 1995. Tree block 65 has a horizontal production passage 73 that extends from hole 67 to a production line (not shown). Production passage 73 registers with wellhead housing production passage 25 and is sealed by seals 74. Production valves 77, 79, which are normally gate valves, are installed in tree block 65 for controlling flow through production passage 25. Tree block 65 also has an annulus passage 81 which joins upper and lower annulus ports 27, 29 to each other. Annulus ports 27, 29 are sealed by seals 82. An annulus access valve 83 allows access from above tubing hanger seals 63 to tubing annulus 62. Annulus valves 85, 87 control lower annulus port 27. An annulus crossover line 89 (FIG. 4), connects annulus passage 81 to production passage 73 via a crossover valve 91. After installation of tree block 65, an ROV (remote operated vehicle) will extend a tool through annulus valves 85, 87 while open to retrieve annulus plug 36 (FIGS. 1, 2). Referring to FIG. 4, various actuators 93, both hydraulic and mechanical, are mounted to tree block 65 for actuating the various valves 77, 79, 85, 87 and 91.

Referring again to FIG. 3, after installing tree block 65, wireline plug 61 (FIG. 2) will be removed. After testing the various valves, a wireline crown plug 95 is installed in tubing hanger vertical passage 55 above lateral passage 57. Then, an internal tree cap 97 is installed within bore 21 of wellhead housing 11. Although not shown, internal tree cap 97 could also have an axial bore with a wireline plug. A downhole safety valve (not shown) has hydraulic passages and lines 99 running through tubing hanger 53 and internal tree cap 97. Alternately, the hydraulic lines for a downhole safety valve could be installed through the side wall of wellhead housing 11 in the general manner as shown in U.S. Pat. No. 5,465,794. A corrosion cap 103 encloses the upper end of wellhead housing 11.

In operation, the operator first installs base 13 on the sea floor. The operator drills the well to a first depth, installing conductor pipe and landing wellhead housing 11 in a slot in base 13. Drilling riser 32 will be employed to lower wellhead housing 11 and will remain in place until tree block 65 is run. Blocking sleeve 31 will be installed on wellhead housing 11 at the vessel and will be in place while wellhead housing 11 is being run. The operator drills the well to completion, installing casing strings 45, 49 conventionally. This stage is shown in FIG. 1.

The operator then installs the string of tubing 56 and lands tubing hanger 53 on upper casing hanger 47. The operator may wish to perforate before installing tubing 53 or after. The operator will then install wireline plug 61 to close off the production tubing 56. For safety, the operator will also install crown plug 95 in tubing hanger axial passage 55 above lateral passage 57. The operator removes drilling riser 32 and blocking sleeve 31.

The operator then lowers tree block 65 with its two sections 65*a*, 65*b* slightly loosened by bolts 71. Tree block 65 will normally be lowered in place by a riser which allows pressure testing from the surface. Once landed on the tapered seat section 23, the operator will tighten bolts 71 with an ROV. The operator tests the various valves 77, 79, 83, 85 and 91. The operator will then remove crown plug 95 and wireline plug 61. The operator then re-installs crown plug 95 and installs internal tree cap 97 and corrosion cap 103.

In the event reentry into the well is needed for workover operations, the operator removes corrosion cap 103. The operator may then employ a drilling riser with a choke and kill line, such as drilling riser 32, which fits around profile 30 of wellhead housing 11. This allows the operator to retrieve internal tree cap 97, crown plug 95 then kill the well. While killing the well, the operator may use a recovery string, which is a high pressure string extending through the center of the drilling riser. The recovery string stabs into the upper end of tubing hanger axial passage 55. By opening annulus access valve 83, annulus valves 85, 87 and closing production valves 77, 79, the operator can pump down the recovery string, through tubing hanger axial passage 55, through tubing 56 and back up tubing annulus 62. Normally, a wireline or other type of operation will take place to open a valve or sliding sleeve at the lower end of tubing 56. This allows the killed fluid to circulate up tubing annulus 62, out lower annulus port 27, through annulus passage 81 and out upper annulus port 83 up through either the choke or kill line of the drilling riser. Once the heavier fluid has replaced the production fluid, the operator may then pull tubing hanger 53 along with the string of tubing 56.

The invention has significant advantages. The two piece tree allows valves, chokes and the like to be located in a portion that may be retrieved for maintenance without pulling the tubing. The housing serves not only as a wellhead housing for drilling, but also as an inner portion of a tree. This arrangement avoids the need for a tree connector to connect the tree to a high pressure wellhead housing.

While the invention has been shown in only one of its forms, it should be apparent to those skilled in the art that it is not so limited but is susceptible to various changes without departing from the scope of the invention.

We claim:

1. A wellhead assembly, comprising:

a tubular housing having a sidewall, an axial bore, and a housing lateral passage extending from the axial bore through the sidewall;

a tubing hanger adapted to be secured to a string of tubing and landed in the housing, the tubing hanger having a vertical passage which communicates with the tubing and a tubing lateral passage which extends from the vertical passage and registers with the housing lateral passage;

a tree block having a central bore for circumferentially receiving the housing, the tree block having an internal tree production passage which registers with the housing lateral passage for directing flow of production fluid from the well; and at least one production valve mounted to the tree block for opening and closing the tree production passage.

2. The wellhead assembly according to claim 1, further comprising:

a casing hanger adapted to be connected to a string of casing, the casing hanger landed in the housing below the tubing hanger.

3. The wellhead assembly according to claim 1, wherein the tree block comprises two separate members, divided from each other at the central bore, and wherein the wellhead assembly further comprises a plurality of fasteners for fastening the two members together around the housing.

4. The wellhead assembly according to claim 1, further comprising:

a lower annulus port in the sidewall of the housing below the tubing lateral passage and leading to a tubing annulus;

an upper annulus port in the sidewall of the housing above the tubing lateral passage and leading to the axial bore of the housing; and an internal bypass passage in the tree block which connects the upper and lower annulus ports to communicate the axial bore above the tubing hanger with the tubing annulus.

5. A wellhead assembly, comprising a tubular housing having a sidewall, an axial bore, and a housing lateral passage extending from the bore through the sidewall;

a tubing hanger adapted to be secured to a string of tubing and landed in the housing, the tubing hanger having a vertical passage which communicates with the tubing and a tubing lateral passage which extends from the vertical passage and registers with the housing lateral passage;

a tree block having a central opening for receiving the housing, the tree block having a tree production passage which registers with the housing lateral passage for directing flow of production fluid from the well;

at least one production valve mounted to the tree block for opening and closing the tree production passage; and a tapered seat area extending around an exterior portion of the housing, the opening in the tree block being tapered and sealingly mating with the seat area.

6. A wellhead assembly, comprising:

a tubular housing having a sidewall, an axial bore, and a housing lateral passage extending from the bore through the sidewall;

a tubing hanger adapted to be secured to a string of tubing and landed in the housing, the tubing hanger having a vertical passage which communicates with the tubing and a tubing lateral passage which extends from the vertical passage and registers with the housing lateral passage;

a tree block having a central opening for receiving the housing, the tree block having a tree production passage which registers with the housing lateral passage for directing flow of production fluid from the well;

at least one production valve mounted to the tree block for opening and closing the tree production passage; and a removable blocking sleeve which engages the housing and blocks the housing lateral passage.

7. A wellhead assembly, comprising:

a tubular housing having a sidewall, an axial bore, and a housing lateral passage extending from the bore through the sidewall;

a tubing hanger adapted to be secured to a string of tubing and landed in the housing, the tubing hanger having a vertical passage which communicates with the tubing and a tubing lateral passage which extends from the vertical passage and registers with the housing lateral passage;

a tree block having a central opening for receiving the housing, the tree block having a tree production passage which registers with the housing lateral passage for directing flow of production fluid from the well;

at least one production valve mounted to the tree block for opening and closing the tree production passage; and a latch mounted to the tree block which engages a profile formed on an exterior portion of the sidewall of the housing for removably securing the tree block to the housing.

8. A wellhead assembly, comprising:

a tubular housing having a sidewall, an axial bore, and a housing lateral passage extending from the axial bore through the sidewall;

a tubing hanger adapted to be secured to a string of tubing and landed in the housing, the tubing hanger having a vertical passage which communicates with the tubing and a tubing lateral passage which extends from the vertical passage and registers with the housing lateral passage;

upper and lower seals extending around the tubing hanger for sealing a junction of the lateral passages;

a lower annulus port in the sidewall of the housing below the lower seal and leading to a tubing annulus;

an upper annulus port in the sidewall of the housing above the upper seal and leading to the bore of the housing;

a tree block having a central bore for circumferentially receiving the housing, the tree block having an internal tree production passage which registers with the housing lateral passage for directing flow of production fluid from the well;

a production valve mounted to the tree block for opening and closing the tree production passage;

an internal bypass passage in the tree block which connects the upper and lower annulus ports to communicate the bore above the tubing hanger with the tubing annulus; and an annulus valve mounted to the tree block for opening and closing the bypass passage.

9. The wellhead assembly according to claim 8, further comprising:

a casing hanger adapted to be connected to a string of casing, the casing hanger landed in the housing below the tubing hanger.

10. The wellhead assembly according to claim 8, wherein the tree block comprises two separate members, divided from each other at the central bore, and wherein the wellhead assembly further comprises a plurality of fasteners for fastening the two members together around the housing.

11. A wellhead assembly, comprising:

a tubular housing having a sidewall, an axial bore, and a housing lateral passage extending from the bore through the sidewall;

a tubing hanger adapted to be secured to a string of tubing and landed in the housing, the tubing hanger having a vertical passage which communicates with the tubing and a tubing lateral passage which extends from the vertical passage and registers with the housing lateral passage;

upper and lower seals extending around the tubing hanger for sealing a junction of the lateral passage;

a lower annulus port in the sidewall of the housing below the lower seal and leading to a tubing annulus;

an upper annulus port in the sidewall of the housing above the upper seal and leading to the bore of the housing;

a tree block having a central opening for receiving the housing, the tree block having a tree production passage which registers with the housing lateral passage for directing flow of production fluid from the well;

a production valve mounted to the tree block for opening and closing the tree production passage;

a bypass passage in the tree block which connects the upper and lower annulus ports to communicate the bore above the tubing hanger with the tubing annulus;

an annulus valve mounted to the tree block for opening and closing the bypass passage; and a tapered seat area extending around an exterior portion of the housing, the opening in the tree block being tapered and sealingly mating with the seat area, the housing lateral passage and the upper and lower annulus ports having openings in the seat area.

12. The wellhead assembly according to claim 11, further comprising:

a latch mounted to the tree block which engages a profile formed on an exterior portion of the sidewall of the housing for removably securing the tree block to the housing.

13. The wellhead assembly according to claim 11, further comprising:

a removable blocking sleeve which engages the housing and blocks the housing lateral passage.

14. The wellhead assembly according to claim 11, further comprising:

a removable blocking sleeve having a central opening for receiving the housing prior to installation of the tree block, the blocking sleeve blocking the opening of the housing lateral passage and upper and lower annulus ports.

15. A method for completing a subsea well, comprising:

(a) providing a tubular housing having a sidewall, an axial bore, and a housing lateral passage extending from the bore through the sidewall;

(b) providing a tree block with a central opening, a tree production passage which extends from the central opening, and a production valve in the tree production passage;

(c) installing the housing at a sea floor at an upper end of a well;

(d) securing a tubing hanger to a string of tubing and landing the tubing hanger in the housing, the tubing hanger having a vertical passage which communicates with the tubing and a tubing lateral passage which extends from the vertical passage and registers with the housing lateral passage; and (e) lowering the tree block over the housing with the housing extending through the opening and the housing lateral passage registering with the tree production passage.

16. The method according to claim 15, further comprising:

before step (d), securing a casing hanger to a string of casing and installing the casing hanger in the housing at a position below the tubing hanger.

17. The method according to claim 15, further comprising:

before step (d), placing a blocking sleeve around the housing to close the housing lateral passage to the exterior; then drilling the well deeper by lowering a drill string through the housing; then after drilling is completed, removing the blocking sleeve and continuing with step (d).

18. The method according to claim 15, further comprising:

opening the production valve and flowing production fluid from the tubing through tubing lateral passage, housing lateral passage and tree production passage.

19. A method for drilling a subsea well, comprising:

(a) providing a tubular housing having a sidewall, an axial bore, and a housing lateral passage extending from the bore through the sidewall;

(b) providing a tree block with a central opening, a tree production passage which extends from the central opening, and a production valve in the tree production passage;

(c) drilling a well to a first depth and installing the housing at a sea floor at an upper end of the well;

(d) installing a blocking sleeve which blocks the housing lateral passage from the exterior; then (d) lowering drill pipe through the housing and drilling the well to a second depth; then (e) running a string of casing through the housing, securing a casing hanger to an upper end of the casing and landing the casing in the housing;

(f) removing the blocking sleeve from the housing after the casing hanger has been installed;

(f) securing a tubing hanger to a string of tubing and landing the tubing hanger in the housing above the casing hanger, the tubing hanger having a vertical passage which communicates with the tubing and a tubing lateral passage which extends from the vertical passage and registers with the housing lateral passage; and (g) after removal of the blocking sleeve, lowering the tree block over the housing with the housing extending through the opening and the housing lateral passage registering with the tree production passage.

20. The method according to claim 19 further comprising controlling production flow through the tubing, tubing lateral passage and tree production passage with the production valve.

* * * * *